US008408514B2

(12) United States Patent
Yadav

(10) Patent No.: US 8,408,514 B2
(45) **Date of Patent: *Apr. 2, 2013**

(54) LOCK MECHANISM FOR BLOWOUT PREVENTER AND METHOD

(75) Inventor: Seemant Yadav, Houston, TX (US)

(73) Assignee: Hydril USA Manfacturing LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/192,908

(22) Filed: Jul. 28, 2011

(65) Prior Publication Data

US 2013/0026394 A1 Jan. 31, 2013

(51) Int. Cl.
*E21B 33/06* (2006.01)

(52) U.S. Cl. ..... 251/1.3; 166/85.4; 137/15.18

(58) Field of Classification Search ..... 166/363, 166/364, 85.4; 251/1.1, 1.3; 137/315.02, 137/15.18

See application file for complete search history.

(56) References Cited

U.S. PATENT DOCUMENTS 4,442,892 A * 4/1984 Delesandri ..... 166/85.1
4,877,217 A * 10/1989 Peil et al. ..... 251/1.3
5,975,484 A * 11/1999 Brugman et al. ..... 251/1.3
6,554,247 B2 * 4/2003 Berckenhoff et al. ..... 251/1.3
7,051,990 B2 * 5/2006 Springett et al. ..... 251/1.1
7,281,586 B2 * 10/2007 Hemphill et al. ..... 166/373
8,028,755 B2 * 10/2011 Darnell et al. ..... 166/379
8,225,857 B2 * 7/2012 Yadav et al. ..... 166/85.4
8,230,930 B2 * 7/2012 Hemphill et al. ..... 166/373
2003/0085040 A1 * 5/2003 Hemphill et al. ..... 166/377
2004/0003920 A1 * 1/2004 Boyd ..... 166/85.4
2005/0236158 A1 * 10/2005 Miyahara ..... 166/379
2007/0114039 A1 * 5/2007 Hobdy et al. ..... 166/379

* cited by examiner

*Primary Examiner* — John K Fristoe, Jr.
*Assistant Examiner* — Umashankar Venkatesan
(74) *Attorney, Agent, or Firm* — Bracewell & Giuliani LLP

(57) ABSTRACT

A blowout preventer for sealing a well includes a body having first and second chambers. The first chamber extends substantially perpendicular to and intersecting the second chamber, and the body includes a recess portion on a face of the body. The blowout preventer also includes a ram block configured to move within the first chamber to seal a first region of the second chamber from a second region of the second chamber; a rod connected to the ram block and configured to extend along the first chamber; a operator configured to be attached to the body to border the first chamber, wherein the rod is configured to slide in and out of the operator; and a lock ring rotatably attached to the operator and configured to enter the recess portion such that the operator is removably attached to the body.

20 Claims, 8 Drawing Sheets

LOCK MECHANISM FOR BLOWOUT PREVENTER AND METHOD

BACKGROUND

1. Technical Field

Embodiments of the subject matter disclosed herein generally relate to methods and systems and, more particularly, to mechanisms and techniques for attaching parts to a body of a ram blowout preventer.

2. Discussion of the Background

The existing technologies for extracting fossil fuels from offshore fields use, among other things, a blowout preventer (BOP) for preventing well blowouts. The BOP is conventionally implemented as a valve to prevent the release of pressure either in the annular space between the casing and the drill pipe or in the open hole (i.e., hole with no drill pipe) during drilling or completion operations. However, various components of the BOP need to be replaced from time to time. An example of a BOP 20 is shown in FIG. 1. The BOP 20 shown in FIG. 1 has, among other things, two ram blocks 22 that are supported by respective piston rods 24 and a corresponding locking mechanism 26. The locking mechanism 26 is configured to lock the rods 24 at desired positions. The two ram blocks 22 are configured to move along a direction parallel to a longitudinal axis of the piston rods 24. The ram blocks 22 may sever a drill string 28 or other tools that cross a vertical wellbore 30 of the BOP 20. However, after cutting the drill string 28 for a number of times, the ram blocks 22 and/or their respective cutting edges need to be inspected and sometimes reworked/replaced. Alternatively, if the ram blocks 22 are designed to seal the well and not to cut a tool, an elastomer provided on a face of the ram blocks 22 needs to be replaced after a certain number of closures of the BOP. For this reason, the BOP 20 of FIG. 1 is provided with a bonnet 32, for each ram block 22, which, for a particular BOP design, can be opened for providing access to the ram blocks. FIG. 2 shows the bonnet 32 having a hinge 34 that rotatably opens the bonnet 32.

Thus, those skilled in the art would recognize that regular service of the BOP is required for changing the blades and/or elastomer attached to the ram blocks. The regular service requires that the BOP bonnets frequently need to be separated from the BOP body to expose and service the ram block. The operation of separating the bonnets from the BOP body is no easy task, and frequently requires special tooling sized to accommodate the large diameter bolts. Such an operation may require several eight-hour shifts of skilled technicians. However, the concern is the amount of down time for the entire rig, which cannot function without the BOP, as millions of dollars of drilling equipment may be idle during the BOP service operation.

A solution to this problem is to design BOPS with bonnetless "doors." However, these designs have other undesirable features. One design utilizes a removable bar (see Brugman et al. U.S. Pat. No. 5,975,484, the entire disclosure of which is incorporated herein by reference), that must be handled and stored when accessing the ram cavity, which can lead to damage or injury during the handling of the bar. The other design has design features that make it expensive to manufacture.

Accordingly, it would be desirable to provide a BOP design that has quick opening features but has a locking mechanism that does not require removal of any supporting parts and is not expensive.

SUMMARY

According to one exemplary embodiment, there is a blowout preventer for sealing a well. The blowout preventer includes a body having first and second chambers, the first chamber extending substantially perpendicular to and intersecting the second chamber, the body including a recess portion on a face of the body; a ram block configured to move within the first chamber to seal a first region of the second chamber from a second region of the second chamber; a rod connected to the ram block and configured to extend along the first chamber; an operator configured to be attached to the body to border the first chamber, wherein the rod is configured to slide in and out of the operator; and a lock ring rotatably attached to the operator and configured to enter and screw into the recess portion such that the operator is removably attached to the body.

According to another exemplary embodiment, there is a blowout preventer that includes a body having a first chamber and a recess portion; an operator configured to be attached to the body and to border the first chamber; and a lock ring rotatably attached to the operator and configured to enter the recess portion such that the operator is removably attached to the body.

According to still another exemplary embodiment, there is a method for assembling a blowout preventer. The method includes a step of providing an operator that includes a rod that is connected to a ram block; a step of attaching the operator to a recess portion formed in a body of the blowout preventer; and a step of rotating a lock ring rotatably attached to the operator and configured to enter the recess portion such that the operator is removably attached to the body.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a ram BOP provided on top of a well head undersea. However, the embodiments to be discussed next are not limited to these systems, but may be applied to other BOPs that may be used, for example, inland.

Reference throughout the specification to "an exemplary embodiment" or "another exemplary embodiment" means that a particular feature, structure, or characteristic described in connection with an embodiment is included in at least one embodiment of the subject matter disclosed. Thus, the appearance of the phrases "in an exemplary embodiment" or "in another exemplary embodiment" in various places throughout the specification is not necessarily referring to the same embodiment. Further, the particular features, structures or characteristics may be combined in any suitable manner in one or more embodiments.

According to an exemplary embodiment, a blowout preventer (BOP) has operators and ram blocks. The operators are configured to accommodate various parts and these operators are configured to screw into a body of the BOP without using hinges as is traditionally used for the bonnets. The operators may have corresponding lock rings that can rotate relative to the operators and the lock rings are configured to screw into the body of the BOP. Thus, according to this embodiment, a bonnetless BOP is manufactured.

One or more advantages associated with this novel BOP are now discussed. It is noted that the novel BOP does not have to have all the advantages. The novel BOP may have one or more of these advantages. One advantage of a bonnetless BOP is the reduced time for reaching the ram blocks. Another advantage is the simplicity with which the operators are attached to the body of the BOP. Still another advantage is the low cost for manufacturing such locking mechanism between the operators and the body. Another advantage may be the lack of parts that are removed and stored during disassembly of the BOP.

Figure 1:
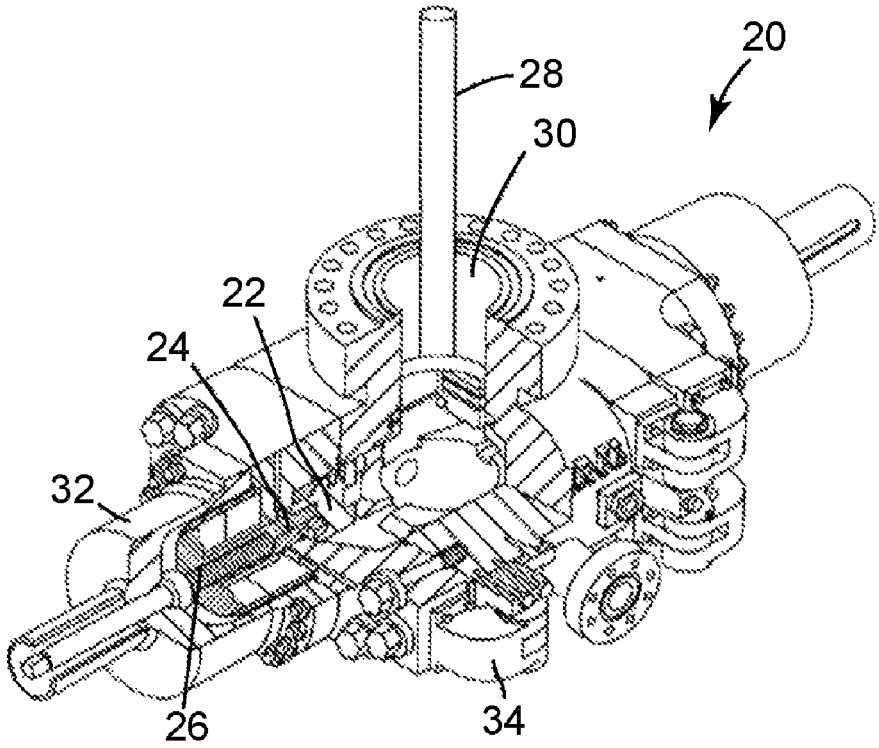
Figure 1 Background Art
FIG. 1 is a schematic diagram of a traditional BOP.
Figure 2:
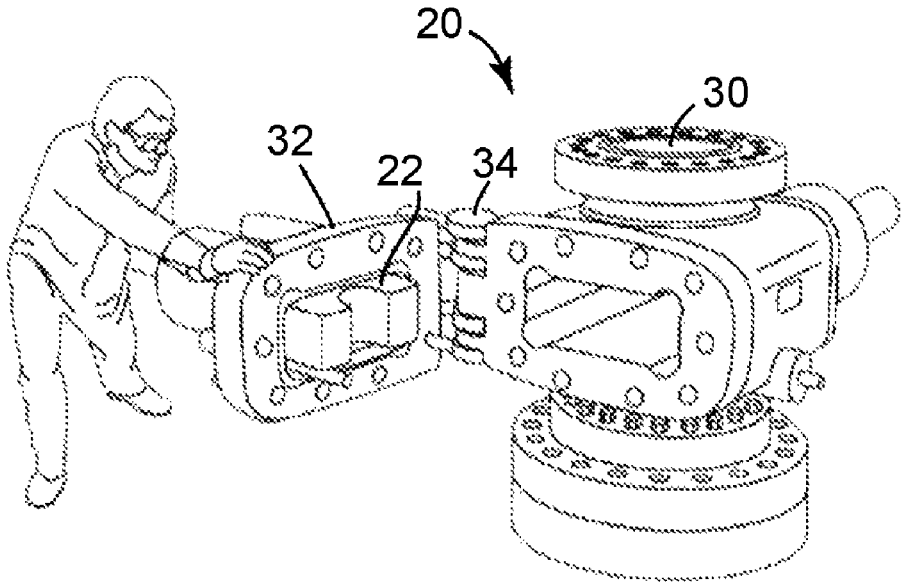
Figure 2 Background Art
FIG. 2 is a schematic diagram of a traditional BOP in an open position.
Figure 3:
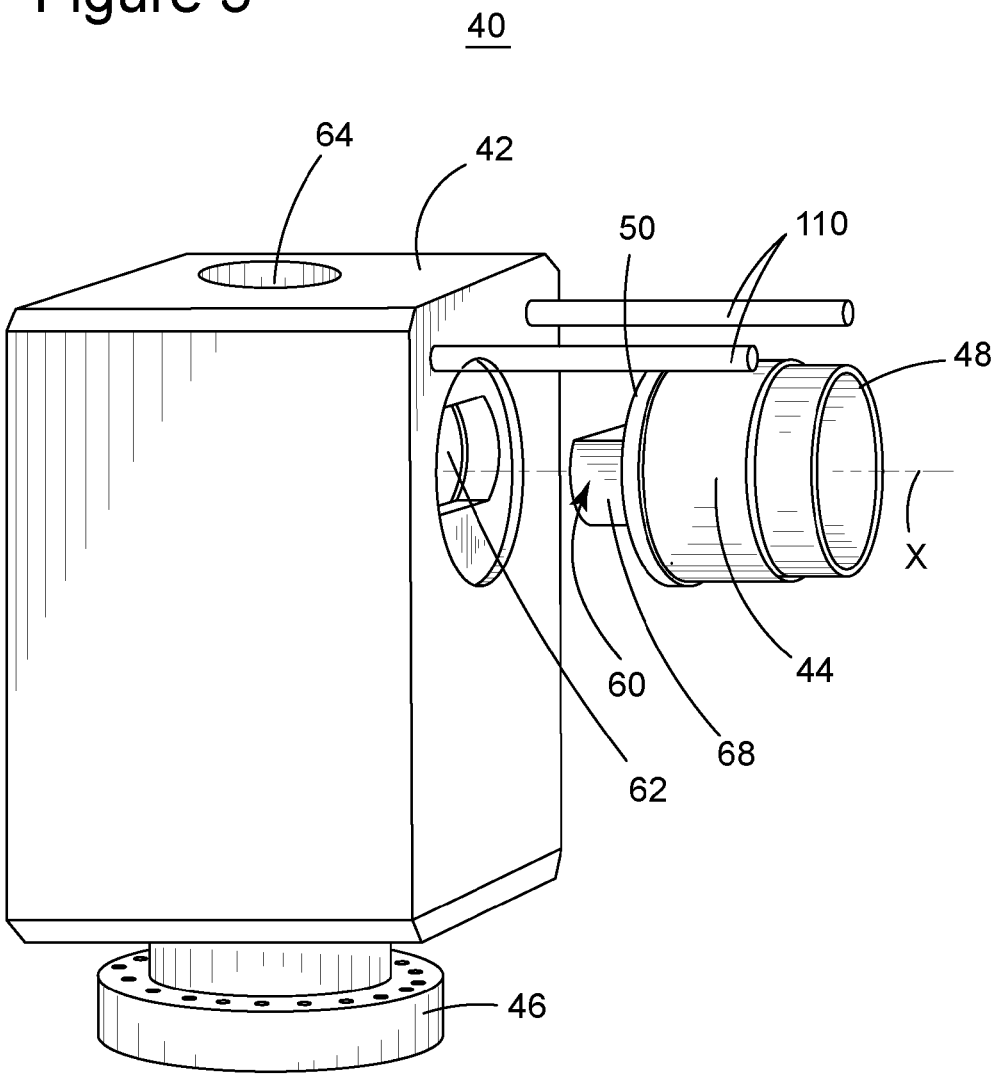
FIG. 3 is a schematic diagram of a bonetless BOP according to an exemplary embodiment.

According to an exemplary embodiment illustrated in FIG. 3, a BOP 40 system includes a body 42 and a operator 44 to be attached to the body 42. Operator 44 has a counterpart operator (not shown) on the other side of the body 42. Body 42 is attached to a flange 46, that is used to attach the entire BOP system 40 to a wellhead. Operator 44 is shown in this figure as being open at side 48. However, when assembled, a cap (not shown) closes side 48 such that a liquid inside cylinder 44 does not escape outside. Various parts of the BOP system 40 are provided inside the cylinder 44, e.g., closing chamber, opening chamber, piston separating the chambers, rod that activates the ram blocks, the ram blocks, etc. These parts are known by those skilled in the art and also have been shown in FIG. 1. For these reasons, these parts are not shown and described here again.

A lock ring 50 may be provided onto operator 44 so that the lock ring 50 may rotate relative to operator 44. The lock ring 50 is threaded on outside as will be discussed later. The size of the lock ring 50 depends on the application, the diameter and the weight of the operator 44, the pressure inside the operator, the materials used for the body 42, etc. The lock ring 50 may be manufactured as a single piece or plural pieces configured to be assembled together. Appropriate materials may be used such that the lock ring will withstand the large pressures and/or forces inside the BOP 40, corrosion and negative effects of salt water.

The operator 44 may include a seal carrier 60 that is configured to enter a first chamber 62 of the body 42. The body 42 also has a second chamber 64 that extends substantially perpendicular on the first chamber 62. The first chamber is configured to accommodate the ram blocks (not shown) and the second chamber accommodates the tools (not shown) to be introduced into the well. Seal carrier 60 is configured to carry a seal 68 to seal an inside of the first chamber 62 from an outside of the body 42. Thus, a working fluid under pressure that is provided in the first chamber 62 is prevented from leaking outside body 42.

Figure 4:
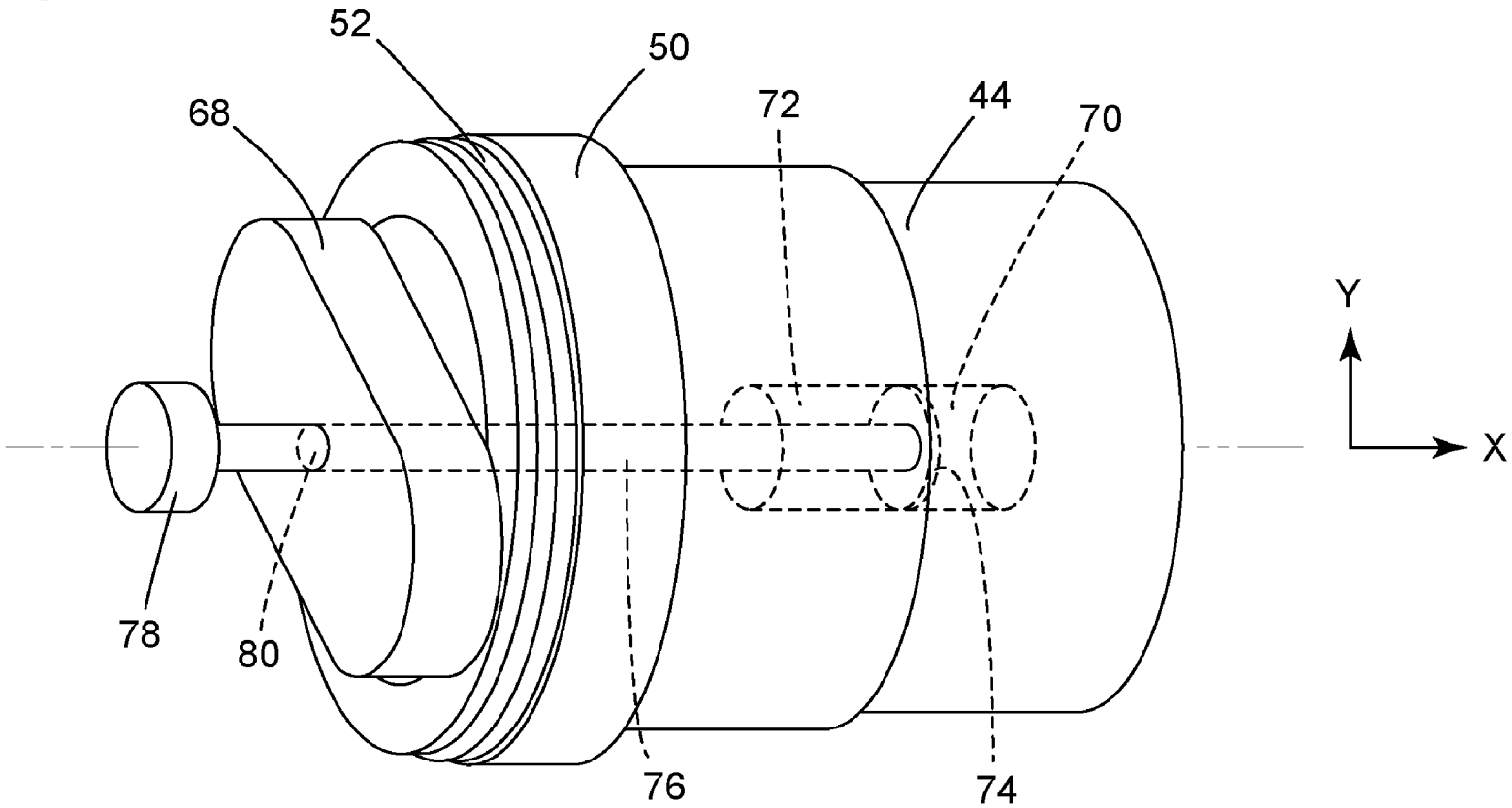
FIG. 4 is a schematic diagram of a block that attaches to a BOP according to an exemplary embodiment.

An overall view of the operator 44 and lock ring 50 is shown in FIG. 4. The lock ring 50 has a thread portion 52 as discussed above. A corresponding receiving thread is present in the body 42 of the BOP for receiving the lock ring 50. As also discussed above, inside the operator 44 there are various components. A couple of these components are the closing chamber 70, the opening chamber 72, a piston 74 separating these chambers, a rod 76 that is connected to the piston 74, and a ram block 78 that is held by the rod 76. Other components are also present inside the operator 44 but are not shown for simplicity. Also, it is noted that the components 70, 72, 74, 76, and 78 are not at scale and are shown simplified as they are known in the art. A hole 80 is present in the seal carrier 60 and the seal 68 for allowing the rod 76 to move back and forth for closing and opening the ram block 78. For completeness, it is noted that the ram block 78 moves along an axis X of the first chamber 62 for separating a first region of the second chamber 64 from a second region of the same chamber. The second chamber 64 extends along an axis Y.

Figure 5:
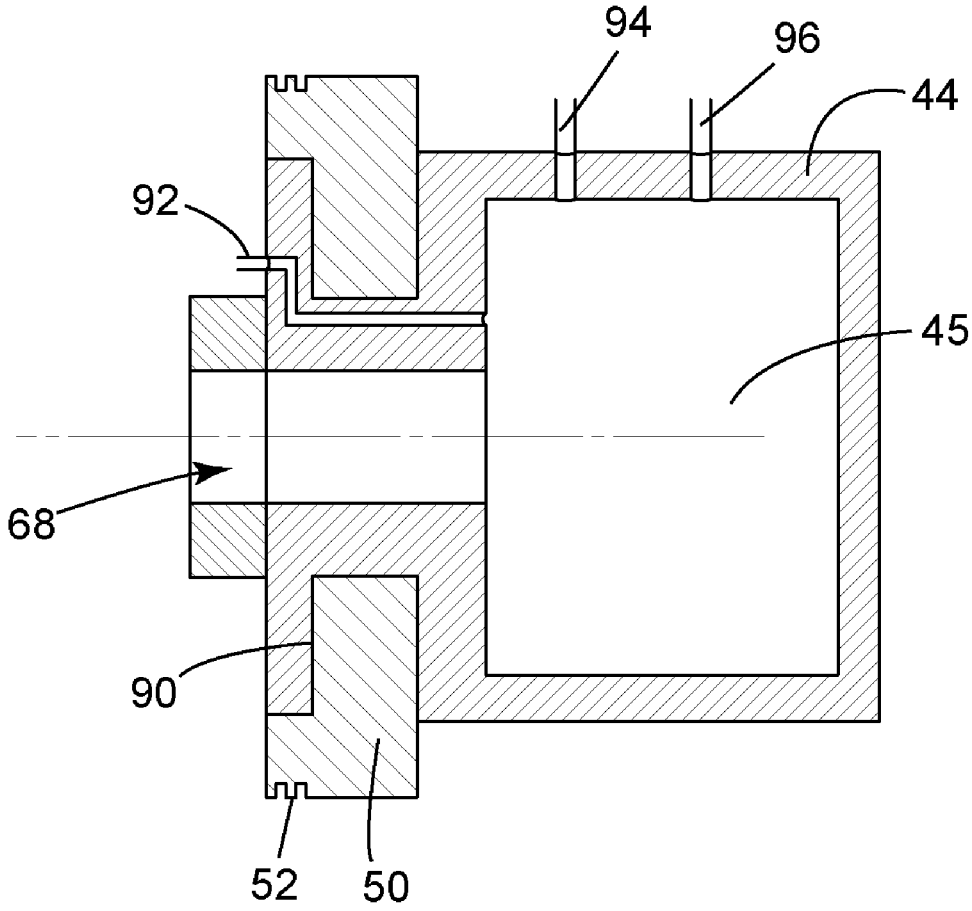
FIG. 5 is a sectional view of a operator and lock ring according to an exemplary embodiment.

A cross-sectional view of the operator 44 and lock ring 50 is shown in FIG. 5. This figure shows a cut through of the operator 44. The operator 44 may be manufactured to be a single piece or two or more pieces. A groove 90 may be formed in the operator 44, on an outer part of the operator, to accommodate the lock ring 50. For this reason, the lock ring 50 may be formed of two or more pieces. FIG. 5 also shows the thread portion 52 of the lock ring 50. A cavity 45 of the operator 44 is configured to accommodate some of the parts 70-78 discussed above. As the closing and opening chambers 70 and 72 need a hydraulic fluid under pressure, there are various possibilities for supplying the fluid to these chambers. FIG. 5 illustrates a couple of these possibilities (see inlets 92, 94, or 96) but those skilled in the art would recognize that there are other ways to bring the fluid to these chambers. It is noted that the inlet 92 is internal to the BOP while the inlets 94 and 96 are external.

Figure 6:
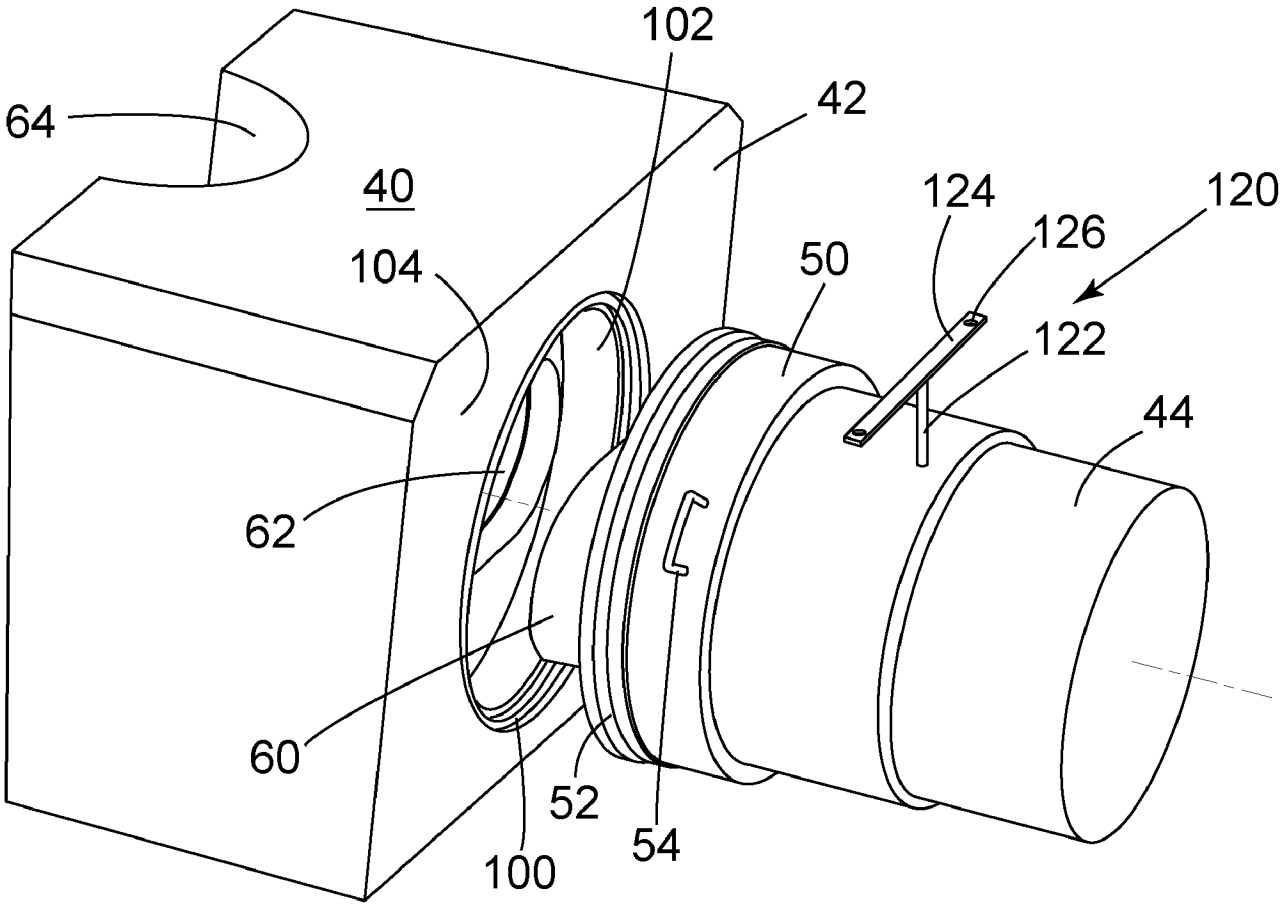
FIG. 6 is an overall view of a operator to be attached to a body according to an exemplary embodiment.

On the BOP 40 side, there is a threaded portion 100 for receiving the threaded portion 52 of the lock ring 50. The threaded portion 100 of the BOP 40 is illustrated in FIG. 6 and is provided in a recess portion 102. The recess portion 102 extends from a face 104 of the BOP 40 inside the body 42 and may be configured to receive part or all of the lock ring 50. The threaded portion 100 may extend partially or totally across the recess portion 102. For treading the lock ring 50 into the body 42 of the BOP 40, given the weight of the operator 44 (e.g., hundreds of kilograms), a device may be necessary for holding the operator 44 aligned with the BOP 40. Thus, as shown in FIG. 3, one or more rails 110 may be used to achieve this goal. For example, the operator 44 may be provided with a hooking mechanism 120 to be attached to the rails 110. Such mechanisms are known in the art and for this reason only a single exemplary mechanism is shown in FIG. 6. However, this mechanism should not be construed to limit the novel features of the invention.

The hooking mechanism 120 includes a first part 122 that is attached to the operator 44 and a second part 124 that has holes 126 for running on the rails 110 (shown in FIG. 3). Bearings may be used to facilitate the movement of the operator along the rails. The lock ring 50 may be provided with one or more handles 54 for providing the operator a means for rotating the lock ring 50 relative to the body 42 when engaging the operator 44 into the body 42.

Figure 7:
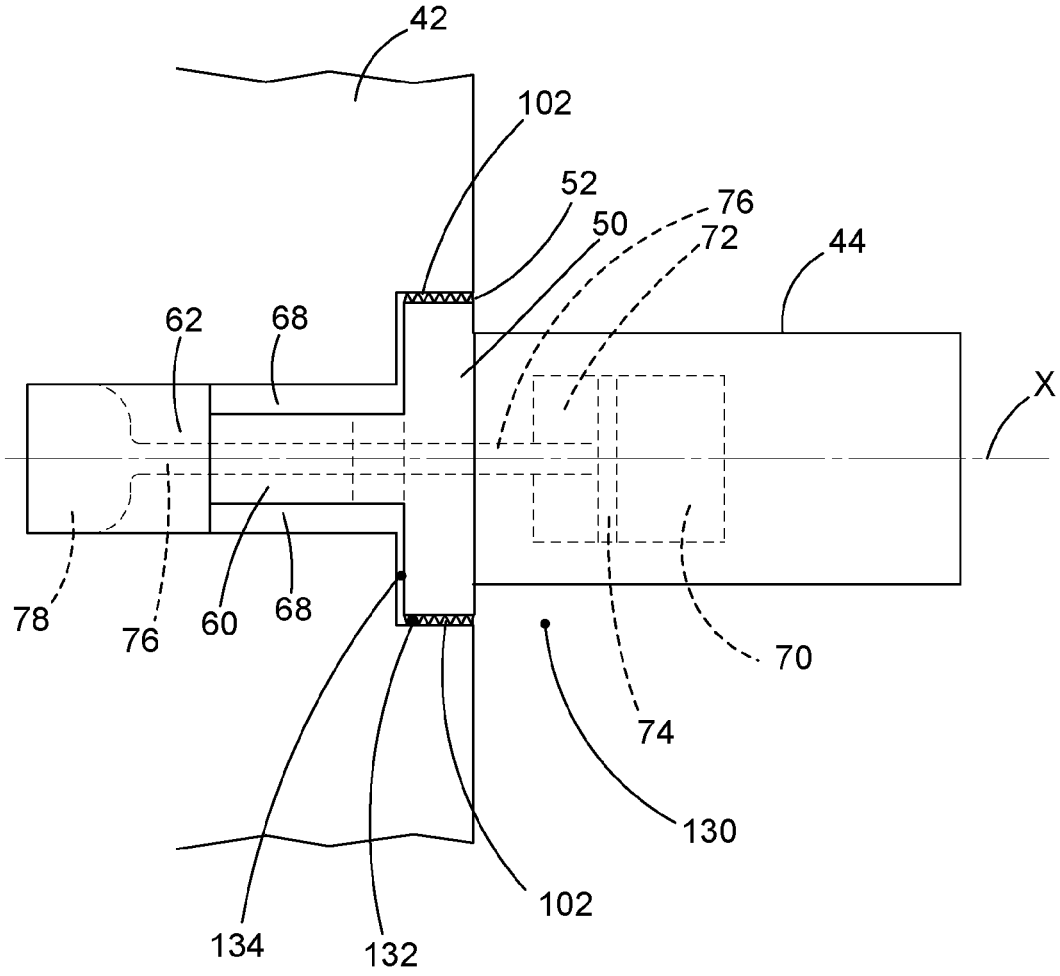
FIG. 7 is a sectional view of a operator when engaged with a body according to an exemplary embodiment.

FIG. 7 shows the operator 44 engaged into the body 42 of the BOP 40. It is seen in this figure that the threaded portion 52 of the lock ring 50 is engaged with the corresponding threaded portion 100 of the body 42. Further, this figure shows that sea water 130 may slip past the threaded portions 52 and 100 trying to enter the recess portion 102 and the first chamber 62. However, the seal 68 is provided on the seal carrier 60 for preventing or minimizing such an effect. Those skilled in the art would recognize that additional seals 132 and 134 may be placed at additional locations, e.g., the recess portion 102, as shown in FIG. 7. In one application, one or both seals 132 and 134 are used instead of the seal 68.

Thus, according to an exemplary embodiment, a blowout preventer for sealing a well may include the following elements: a body (42) having first and second chambers (62, 64), the first chamber (62) extending substantially perpendicular to and intersecting the second chamber (64), the body (42) including a recess portion (102) on a face of the body (42); a ram block (78) configured to move within the first chamber (62) to seal a first region of the second chamber (64) from a second region of the second chamber (64); a rod (76) connected to the ram block (78) and configured to extend along the first chamber (62); a operator (44) configured to be attached to the body (42) to border the first chamber (62), wherein the rod (76) is configured to slide in and out of the operator (44); and a lock ring (50) rotatably attached to the operator (44) and configured to enter the recess portion (102) such that the operator (44) is removably attached to the body (42).

Figure 8:
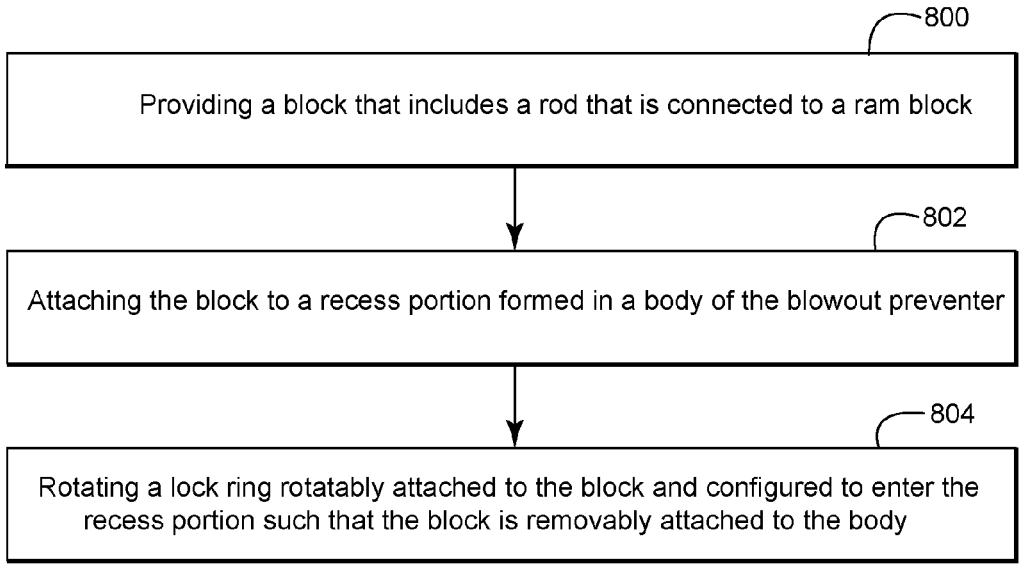
FIG. 8 is a flow chart illustrating a method for attaching a operator to a body of a BOP according to an exemplary embodiment.

According to an exemplary embodiment illustrated in FIG. 8, there is a method for assembling a blowout preventer. The method includes a step 800 of providing a operator that includes a rod that is connected to a ram block; a step 802 of attaching the operator to a recess portion formed in a body of the blowout preventer; and a step 804 of rotating a lock ring rotatably attached to the operator and configured to enter the recess portion such that the operator is removably attached to the body.

The disclosed exemplary embodiments provide a BOP system and a method for attaching a operator to a body of the BOP without using hinges, screws, bolts or other similar mechanisms. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A blowout preventer, comprising:
a body having first and second chambers, the first chamber extending substantially perpendicular to and intersecting the second chamber, the body including a recess portion on a face of the body;
a ram block configured to move within the first chamber to seal a first region of the second chamber from a second region of the second chamber;
a rod connected to the ram block and configured to extend along the first chamber;
an operator configured to be attached to the body to border the first chamber, wherein the rod is configured to slide in and out of the operator; and
a lock ring rotatably attached to the operator and configured to enter and screw into the recess portion such that the operator is removably attached to the body.

2. The blowout preventer of claim 1, wherein the lock ring includes a threaded portion on an outside surface.

3. The blowout preventer of claim 2, wherein the recess portion includes a threaded portion that is configured to receive the threaded portion of the lock ring.

4. The blowout preventer of claim 3, wherein the lock ring screws into the recess portion of the body of the BOP to fix the operator relative to the BOP.

5. The blowout preventer of claim 1, where the operator comprises:
a closing chamber;
an opening chamber; and
a piston that separates the closing chamber from the opening chamber;
wherein the rod is linked to the piston.

6. The blowout preventer of claim 1, further comprising:
a seal carrier attached to the operator; and
a seal attached to the seal carrier such that a fluid under pressure inside the operator does not escape the operator.

7. The blowout preventer of claim 6, wherein the seal is configured to enter the first chamber.

8. The blowout preventer of claim 1, further comprising:
seals provided between the recess portion and the lock ring.

9. The blowout preventer of claim 1, wherein the operator includes a groove configured to rotatably receive the lock ring.

10. The blowout preventer of claim 1, wherein the operator is in direct contact with an outside environment of the body as there are no bonnets.

11. The blowout preventer of claim 1, further comprising:
one or more guiding rails attached to the face of the body and configured to hold or slide the operator when the operator is not engaged with the body.

12. A blowout preventer, comprising:
a body having a first chamber and a recess portion;
an operator configured to be attached to the body and to border the first chamber; and
a lock ring rotatably attached to the operator and configured to enter the recess portion such that the operator is removably attached to the body.

13. The blowout preventer of claim 12, where the operator comprises:
a closing chamber;
an opening chamber;
a piston that separates the closing chamber from the opening chamber;
a rod linked to the piston; and
a ram block connected to the rod.

14. The blowout preventer of claim 12, wherein the lock ring includes a threaded portion on an outside surface.

15. The blowout prevent of claim 14, wherein the recess portion includes a threaded portion that is configured to receive the threaded portion of the lock ring.

16. The blowout prevent of claim 12, further comprising:
at least a seal provided between the recess portion and the lock ring.

17. The blowout prevent of claim 12, wherein the block includes a groove configured to rotatably receive the lock ring.

18. A method for assembling a blowout preventer, the method comprising:

providing an operator that includes a rod that is connected to a ram block;

attaching the operator to a recess portion formed in a body of the blowout preventer; and rotating a lock ring rotatably attached to the operator and configured to enter the recess portion such that the operator is removably attached to the body.

19. The method of claim 18, further comprising:

engaging a threaded portion of the lock ring with a threaded portion of the recess portion.

20. The method of claim 19, further comprising:

rotating the lock ring to screw it into the recess portion.

* * * * *